United States Patent [19]

Schmidt et al.

[11] 4,270,938

[45] Jun. 2, 1981

[54] PROCESSES FOR DECONTAMINATING NUCLEAR PROCESS OFF-GAS STREAMS

[75] Inventors: Wallace B. Schmidt, Warren; William W. Lewis, Green Brook; Alex Edmiston, Sparta; Gernot Klauser, North Plainfield, all of N.J.

[73] Assignee: Airco, Inc., Montvale, N.J.

[21] Appl. No.: 966,447

[22] Filed: Dec. 4, 1978

[51] Int. Cl.[3] ..... F25J 3/08

[52] U.S. Cl. ..... 62/22; 423/210; 423/219; 423/239; 423/262; 423/351; 176/37

[58] Field of Search ..... 423/262, 210, 219, 239, 423/351; 62/22; 176/37

[56] References Cited

U.S. PATENT DOCUMENTS

| | | | |
|---|---|---|---|
| 3,501,923 | 3/1970 | Lehmer | 62/22 X |
| 3,609,983 | 5/1968 | Lofredo et al. | 62/22 |
| 3,748,864 | 7/1973 | Lofredo et al. | 62/22 |
| 3,944,646 | 3/1976 | Martin | 62/22 X |
| 4,012,490 | 3/1977 | Lofredo | 62/22 X |
| 4,045,191 | 8/1977 | Martin | 62/22 X |
| 4,080,429 | 3/1978 | Koeppe et al. | 62/22 X |

*Primary Examiner*—Earl C. Thomas
*Attorney, Agent, or Firm*—David L. Rae; Larry R. Cassett

[57] ABSTRACT

In a process for decontaminating a nuclear process off-gas stream, oxygen and oxides of nitrogen are removed by catalytic reaction with hydrogen. The feed gas stream is then passed serially through a drier, a carbon dioxide adsorber and a xenon adsorber to sequentially remove water, $CO_2$ and xenon therefrom. The feed gas exiting the xenon adsorber is passed to a krypton recovery process wherein krypton is concentrated to a first level in a primary distillation column, partially evaporated to increase concentration thereof and is brought to a concentration of approximately 90 mol % or greater in a second distillation column thereby enabling efficient storage of a radioactive krypton product. The xenon gas removed from the main feed stream in the xenon adsorber is passed to a freeze-out heat exchange device to concentrate xenon to approximately 99% or greater, balance krypton. The minor fraction of krypton may then be removed from such xenon-rich product in a distillation tower with the xenon product being stored in gas cylinders or the like.

11 Claims, 3 Drawing Figures

PROCESSES FOR DECONTAMINATING NUCLEAR PROCESS OFF-GAS STREAMS

BACKGROUND OF THE INVENTION

The present invention relates to methods for separating component gases from a feed gas stream and more particularly, to a process for removing xenon and radioactive krypton from the off-gas streams of nuclear processes.

Nuclear power generation and nuclear fuels reprocessing generate several types of radioactive waste, including an off-gas stream which contains various concentrations of radioactive Kr-85. These concentrations are generally in excess of levels which can be safely released to atmosphere due to high levels of radioactivity and consequently, processes have been devised in attempts to remove radioactive krypton from such gas streams. The removed krypton is held in suitable storage vessels until radioactive decay is sufficient to enable subsequent release or use of such krypton.

Previously proposed processes typically include the removal from nuclear process off-gas streams of certain constituents in a "warm" end and other constituents in a cryogenic portion of the process. For example, oxygen and oxides of nitrogen may be removed by catalytic combustion and the resulting water may be dried from the main stream gas in appropriate devices in the warm end of the system. Usually, carbon dioxide is adsorbed from the resulting feed gas stream in suitable adsorber devices in the warm end of the system while xenon and krypton are separated from the feed gas stream in cryogenic distillation towers or the like. Previously proposed techniques for decontaminating nuclear process off-gas streams have suffered from several drawbacks. Generally, such processes do not assure virtually complete removal of radioactive components from the off-gas stream and these processes have been ineffective in reducing to practical levels the volumes of gases from which components such as radioactive krypton are removed. This latter deficiency of previously proposed processes results in excessive capital costs because of the relatively large volumes of gas involved and the manner in which such processes have attempted to decontaminate the same. For example, it has been proposed in U.S. Pat. No. 4,080,429 to separate krypton from the off-gas stream of a nuclear process. However, in this separation process, helium is specifically relied upon as a carrier gas and consequently, the overall volume of gases treated is relatively large. This, in turn, results in concomitant increased capital costs of apparatus necessary to treat a given volume of contaminated gas. Other proposed prior art processes include the method described in U.S. Pat. No. 3,944,646 in which it is stated that krypton and xenon are separated from one another in a single column. Although this type of separation may operate in the manner described, the process illustrated in this reference relies upon a total reflux of liquid nitrogen and thus results in a process relatively expensive to operate in that large quantities of 'utility' or commercially pure nitrogen liquid are required.

In another process described in the prior art, namely U.S. Pat. No. 4,012,490, which is assigned to the assignee of the present invention, it is proposed to separate carbon dioxide and xenon in a single adsorber stage and recover this combined material for storage. It has been found, however, that due to the solubilities of the constituents involved, the separation of a combined $CO_2$-xenon product is not entirely feasible and may result in the unavoidable inclusion of krypton with such combined product. A similar process is illustrated in U.K. Patent Specification No. 1,525,686.

Consequently, a review of prior art processes indicates a clear need for a technique for decontaminating nuclear process off-gas streams in a manner which is thorough, safe and yet does not incur excessive capital or equipment costs and is both reliable and efficient to operate on a virtually continuous basis.

OBJECTS OF THE INVENTION

It is an object of the present invention to provide an improved process for decontaminating nuclear process off-gas streams.

It is another object of the present invention to provide improved processes for effectively removing krypton and xenon from nuclear process off-gas streams.

It is a further object of the present invention to provide an improved process for decontaminating a nuclear off-gas stream by avoiding the loss of radioactive constituents to atmosphere.

It is yet another object of the present invention to provide a process for decontaminating a nuclear off-gas stream by producing separate krypton and xenon products of high purity.

Other objects of the present invention will become apparent from the detailed description of an exemplary embodiment thereof which follows, and the novel features of the present invention will be particularly pointed out in conjunction with the claims appended hereto.

SUMMARY

In accordance with the present invention, a nuclear process off-gas stream comprising oxygen, nitrogen, oxides of nitrogen, krypton, xenon, carbon dioxide and minor quantities of inert gases are subjected to a process in which virtually all of the feed stream krypton is recovered as a product comprising at least 90% krypton, and virtually all of the xenon is recovered as a xenon product preferably containing less than 100 ppm krypton. In accordance with the invention, the feed gas stream is passed through a catalytic reactor wherein external hydrogen is introduced and reacted with oxygen and oxides of nitrogen to produce water and nitrogen. This water is subsequently removed by condensation and/or drying of the feed stream and subsequently, carbon dioxide is removed from the feed gas stream in a $CO_2$ adsorber. Any krypton adsorbed with carbon dioxide is returned to the inlet of the decontamination process. The feed gas stream is subsequently passed from the $CO_2$ adsorber to a xenon adsorber which is effective to adsorb virtually all of the xenon and discharge to a krypton recovery stage a gas stream comprised essentially of krypton, hydrogen, nitrogen, less than 10 ppb oxygen and minor quantities of other inert gases. The xenon-rich adsorbate is passed to a recovery stage which includes a freezeout heat exchanger and may include a xenon distillation column. In this exchanger, a relatively low concentration xenon feed gas is concentrated to approximately 99% which in turn may be further purified in other apparatus to reduce the krypton content thereof to a particular level, such as less than 100 ppm. The resulting xenon product is recovered for storage and/or other use.

In accordance with the invention, krypton is recovered by continuously passing the main gas stream from the xenon adsorber to a first distillation column wherein the bottoms liquid-vapor mixture containing a relatively dilute concentration, e.g. 1% krypton, is collected and passed to a monitor tank wherein liquid and vapor phases are separated and krypton is accumulated in association with a substantial ("heat sink") of cryogenic liquid. On an intermittent basis, batches of liquid in the monitor tank are passed to an evaporator vessel wherein the liquid phase is partially evaporated to produce a krypton containing liquid residue preferably comprised of at least 5% krypton. This liquid residue is subsequently introduced into a second distillation column to produce a bottoms liquid therein of at least 90% krypton, balance argon. By utilization of a preliminary evaporation and concentration step, the liquid receiving volume provided in the second distillation column sump is reduced, and consequently, less low purity vapor coexists with the high purity liquid remainder at the end of batch distillation. This allows withdrawal of liquid product with less admixture of low purity vapor phase and avoids excessive overconcentration of krypton and objectionable impurities such as ozone in the liquid phase before product is withdrawn.

Similarly, by evaporating the initially large volume of admixed nitrogen in the freezeout exchanger after the freezeout step of the xenon recovery stage, nitrogen is virtually eliminated from the charge before it is transferred to the xenon distillation column. This enables a large reduction in the size of the xenon column reboiler and gives the same advantage described above for the krypton secondary column. In addition, the virtual elimination of nitrogen from the liquid charged to the xenon column reboiler avoids the overcooling of the distillation apparatus that would result from evaporation of nitrogen therein. Such overcooling would be likely to cause plugging of the column when the batch distillation was in transition between the ternary $N_2$—, Kr—, Xe system and the binary Kr—, Xe system, unless great care were exercised in manipulation of the apparatus. Consequently, upon practice of the process according to the invention, efficient and easily manipulated final distillations of purified products are made possible.

In order to avoid the loss of radioactive krypton, overhead gas from the secondary distillation column in this purification system is also recycled to the primary column. Similarly, overhead gas from the xenon distillation column which contains krypton is recycled to the inlet of the overall decontamination process.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENT

Figure 1:
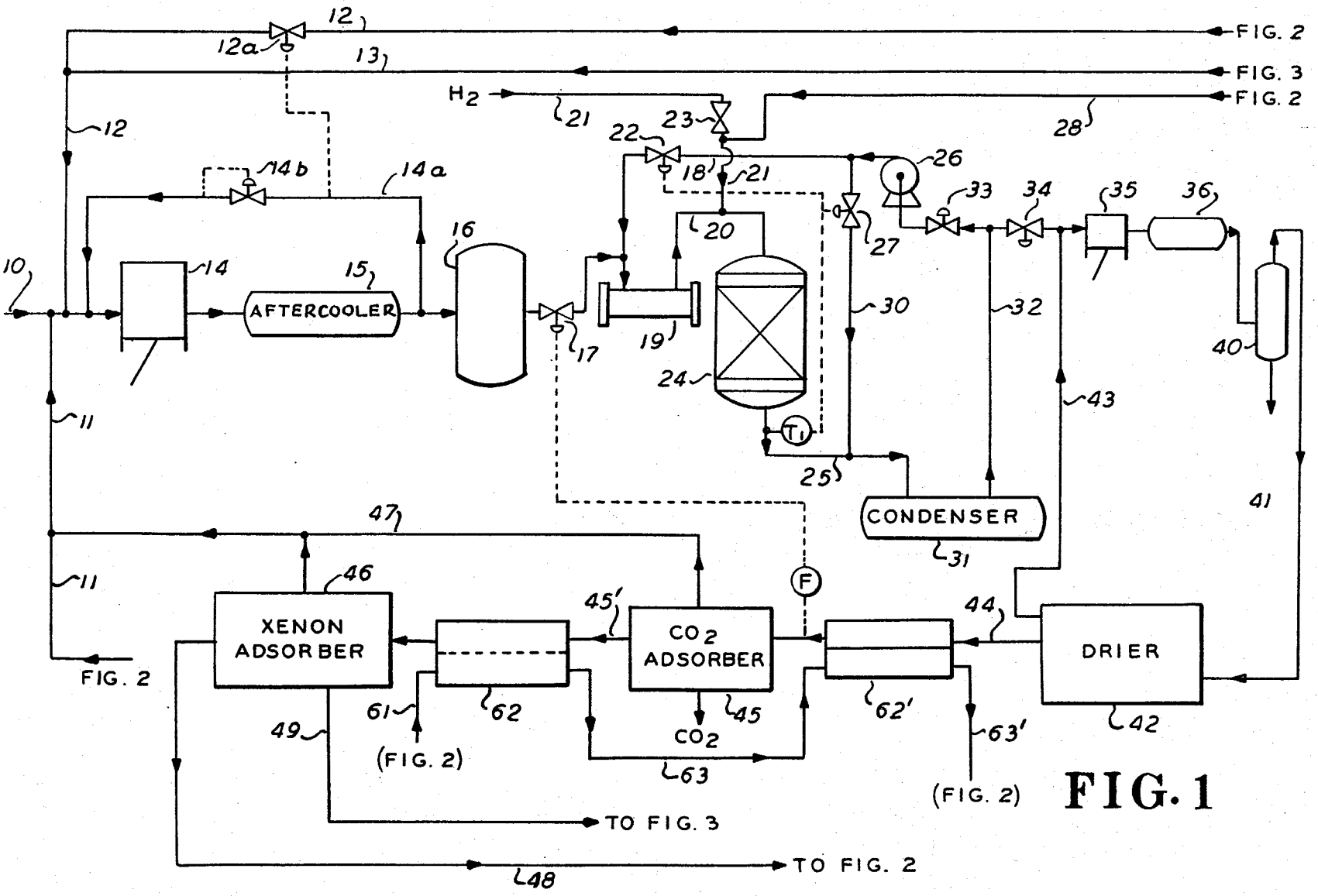
FIG. 1 is a diagrammatic view of the 'warm end' of apparatus for practicing the process according to the invention.
Figure 2:
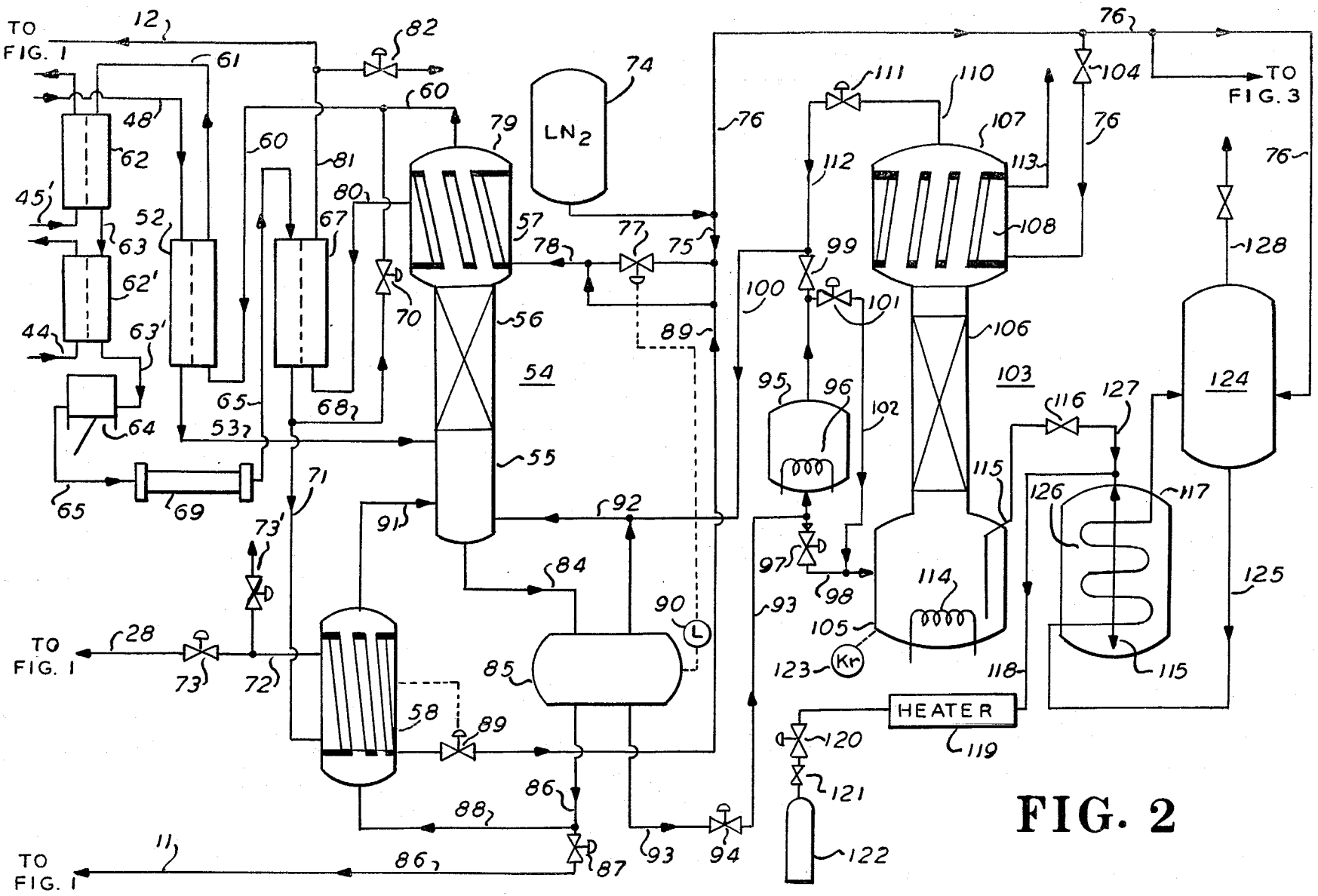
FIG. 2 is a diagrammatic view of apparatus for purifying krypton by the process according to the invention.

Referring now to FIG. 1, illustrated therein is an exemplary embodiment of apparatus for removing oxygen, oxides of nitrogen, carbon dioxide and xenon from a nuclear process off-gas stream containing such constituents in addition to radioactive krypton. The off-stream gas supplied at inlet 10, which may comprise the gaseous effluent of a nuclear fuels reprocessing plant, is typically comprised of approximately 63% nitrogen, 36% oxygen, 60 ppm krypton, 500 ppm xenon, 200 ppm $NO_x$, 300 ppm $CO_2$, and minor quantities of moisture, argon, neon, and helium. This gas stream is preferably supplied to the inlet of compressor 14 at a sub-atmospheric pressure together with recycle streams supplied through lines 11, 12 and **14*a* which are compressed to a maximum pressure of approximately 10 kg/cm$^2$ and supplied to aftercooler 15 wherein the temperature is reduced before a portion thereof is recycled through line 14*a* while the remainder is passed to surge drum 16. A flow of decontaminated nitrogen gas passes through line 12 and control valve 12*a* therein to the inlet of compressor 14. This flow is regulated by sensing the pressure in line 14*a* and hence the pressure in drum 16. Thus, upon detecting a decrease in pressure of drum 16 to approximately 2 kg/cm$^2$, valve 12*a* opens to supply decontaminated nitrogen gas to compressor 14. Under normal operating conditions, valve 12*a* will remain closed. Consequently, critical parts of the downstream separation process (FIGS. 2 and 3) will receive a substantially constant gas flow rate and disturbances which could occur from extreme variations in the flow rate of feed gas supplied to inlet 10 will be prevented. Recycle line 14*a* is utilized to adjust the capacity of compressor 14 to match the general plant feed requirements and by means of control valve 14*b*, a recycle flow through line 14*a* is effective to maintain a constant suction pressure at the inlet of compressor 14. Line 13 will contain a relatively low flow of krypton contaminated overhead gas discharged from xenon distillation tower 172 (FIG. 3) and this contaminated gas is recycled for reprocessing together with decontaminated nitrogen as illustrated in FIG. 1. In addition, krypton contaminated gas eluted from $CO_2$ adsorber 45 and xenon adsorber 46 are returned on an intermittent basis through line 47 to the inlet of compressor 14. A krypton contaminated flow occasionally occurs in line 11 which constitutes a fraction of the liquid phase substance in monitor tank 85 in the primary krypton distillation system (FIG. 2**).

Compressor 14 is preferably a two-stage reciprocating compressor provided with a no-loss seal arrangement adapted such that all seal leakage will be inward of the compressor. The discharge pressure of compressor 14 will vary over a range of approximately 2.5–10 kg/cm$^2$ absolute and the flow through recycle line **14*a*, as mentioned above will be utilized to control the flow of decontaminated recycle nitrogen through control valve 12*a* to maintain normal process flow rates whenever the accumulation of feed gas in surge drum 16 (coupled to receive the gas cooled in aftercooler 15) approaches a minimum level. Preferably compressor 14 is effective to store quantities of feed gas in excess of the process capacity in drum 16 and thereby enable the release of stored feed gas to the process whenever the off-gas flow at inlet 10 is low. Accordingly, the flow of recycle gas through line 12** is controlled as mentioned above to enable such plant operation.

The feed gas in surge drum 16 is passed through control valve 17 where it joins a recycle stream and is admitted into preheater 19 wherein the temperature is raised to approximately 150° C. before the combined stream is passed through line 20. Hydrogen is supplied in slight excess of the stoichiometric ratio through line 21 and valve 23 and joins the stream in line 20 for passage to deoxidizing reactor or combiner 24 wherein the concentrations of oxygen and $NO_x$ are reduced to approximately 10 ppb. Reactor 24 is preferably a catalytic combustion chamber in which uncombined oxygen and oxygen combined as $NO_x$ and hydrogen react in the presence of a catalyst and produce moisture and nitrogen which materials together with the remainder of the feed gas stream are discharged through line 25. A recycle stream which will be subsequently described is passed through line 30 and joins the main stream in line 25 which is then passed through externally cooled condenser 31 wherein moisture is separated in known manner from the main feed stream by condensation. The main stream is discharged from condenser 31 through line 32 and the major portion thereof is returned through control valve 33 to circulator 26 and valve 22 in line 18 to heater 19 while a minor portion of the main stream is passed through control valve 34 for further treatment.

It is desirable to maintain, or at least limit the reactor 24 exit temperature, while at the same time maintaining a constant flow of process gas to the cryogenic system downstream of the driers in line 44. Since the oxygen content of the off-gas stream 10 will average about 36% and will be subject to wide variations, possibly from 0 to 100% oxygen, being at most times far above the level suitable for direct adiabatic (uncooled) reaction with hydrogen (because impractically high reactor temperature would occur), an automatically controlled blending system is used in which previously reacted and therefore inert main stream or process gas is recirculated at a variable rate and caused to mix with newly added gas before passing through the reactor. At the same time, the inflow of new gas through valve 17 is automatically varied in response to indicator F to maintain a constant net flow of dry oxygen and $NO_x$-free gas downstream of the driers in line 44. Since the reactor outlet temperature is approximately a linear function of the oxygen concentration of the stream entering the reactor regardless of the reactant flow rate, a suitable means of control for this part of the system includes a temperature controller $T_1$ which is responsive to the reactor 24 exit temperature and is effective to control valves 22 and 27 so that appropriate quantities of the previously mentioned diluent recycle gas are combined with the untreated oxygen-bearing main stream at the inlet of preheater 19. This has the indirect effect of controlling the oxygen concentration of the gas supplied to reactor 24 at an average value of about 3.5% or so. Excess diluent gas is returned through control valve 27 and line 30 to condenser 31.

Although the preferred oxygen concentration of gas supplied to reactor 24 is about 3.5% it will be understood that concentrations of between about 1% and 4% may be utilized. The particular concentration will depend upon design and economic choices made in any particular case in consideration of catalyst choice, cost and availability of approved temperature resistant pressure vessel material, provision for spontaneous deflagration of unreacted mixture, and whether hydrogen or ammonia reagent is utilized for reaction with oxygen.

A relatively low flow of non-condensible gas comprised essentially of hydrogen and nitrogen is returned from the cryogenic section (FIG. 2) through conduit 28 and joins the supply of hydrogen in line 21 utilized for combination with oxygen in the main feed stream in reactor 24. The main stream in line 32 is preferably analyzed for hydrogen content and in accordance with such analysis, the flow of hydrogen through line 21 and valve 23 is appropriately controlled at a value above the stoichiometric quantity required for reaction in reactor 24. By maintaining an excess of hydrogen at all times, virtually complete conversion of free oxygen and $NO_x$ is assured and protection against oxygen "breakthrough" due to a temporary deficiency of hydrogen is prevented. Accordingly, deoxidizing reactor or combiner 24 is effective in a safe and efficient manner to reduce the oxygen and $NO_x$ concentrations in the main feed stream to virtually undetectable levels on the order of 10 ppb.

The main gas stream undergoing treatment next passes through valve 34 and is joined by a stream of regeneration gas in line 43 which combined flow is passed to the inlet of compressor 35. This compressor is preferably a single stage electrically driven machine constructed with a "no-loss" seal system. The composition of the gas stream at the inlet to compressor 35 is approximately 92.5% nitrogen, 6.6% $H_2O$, 0.51% hydrogen, 26 ppm krypton, 250 ppm xenon, 3611 ppm argon, neon and helium, 135 ppm $CO_2$, and 10 ppb $O_2$, $NO_x$. Compressor 35 is effective to pass the main gas stream under a substantially constant flow to aftercooler 36 wherein a portion of the moisture in the gas stream will condense with the major stream being then further chilled by means of an evaporator (not shown) before passage to water separator 40. The main gas stream is chilled to a temperature of approximately 4° C. before introduction into separator 40 which is preferably a vessel equipped with a wire-mesh demisting pad which is effective to remove entrained moisture from a gas stream. Typically, the moisture concentration of gas leaving separator 40 through line 41 will be approximately 2200 ppm and it is this gas which is then passed to drier 42 for a more complete removal of moisture.

Drier 42 is preferably a dual bed system of two vessels connected in parallel which are alternately placed in service and isolated for regeneration. Upon passage of the main gas stream through a drier bed in service, the moisture content thereof is reduced to about 1 ppm. During regeneration, the other bed is initially depressurized and then heated with regeneration gas which is taken from the outlet of the drier in service. The regeneration gas preferably comprises only a minor portion of the main stream leaving the drier in service and upon desorption of virtually all moisture from the bed undergoing regeneration, the flow of regeneration gas is continued in an unheated state. The regeneration gas leaving the drier bed is subsequently cooled and returned through line 43 to the inlet of compressor 35. Subsequently, the bed undergoing regeneration is repressurized and placed on stream overlapping the onstream operation of the bed in service for a few minutes before the bed in service is isolated and depressurized to then undergo a regeneration cycle. The dried, main gas stream is then passed through line 44 to a heat exchanger 62' wherein this gas is cooled to a temperature of approximately −73° C. before passage to $CO_2$ adsorber 45 from which this main gas stream is discharged through line 45'. As illustrated in FIG. 2, heat exchanger 62′ is provided with an inlet line 63 which receives cool gas from heat exchanger 62, which is received through line 61 from condenser 52 (FIG. 2) thereby cooling the main gas stream in line 44 which line is also shown in FIG. 2.

$CO_2$ adsorber 45 is preferably configured as a multiple bed system of two or more vessels connected in parallel with lines and valves by which such vessels can alternately be placed in service for adsorption or isolated for regeneration. Typically, such beds are filled with molecular sieve type 13X which exhibits a high capacity for adsorbing carbon dioxide at −73° C. Briefly, regeneration of a saturated bed is effected by isolating such bed from the main gas stream, depressurizing the same and supplying a flow of warm eluting gas through the adsorber in the forward direction. Preferably, the eluting gas is drawn from a decontaminated process gas stream intermittently and the eluting gas exiting adsorber 45 containing all of the krypton that had been co-adsorbed with carbon dioxide is recycled through line 47 to line 11 and is reinserted into the process at the inlet of compressor 14. After this initial eluting, the elution process is continued with the application of external heat, such as from a flow of hot nitrogen gas through the adsorber jacket, which gas is preferably supplied from an independent nitrogen supply. This eluting gas flow continues to be recycled through lines 47 and 11 to compressor 14 until the adsorber shell temperature reaches approximately 10° C. and at which point residual krypton in the adsorbent material has been reduced to a virtually undetectable trace while virtually all of the $CO_2$ remains fixed in the adsorbent bed. At this point, the supply of elution "sweep" gas is terminated and the bed is heated so as to drive off $CO_2$ vapor to atmosphere through appropriate vent valves. After desorption of carbon dioxide the supply of elution gas is recommenced to sweep $CO_2$ from the interstitial spaces in the adsorbent to the vent before the adsorber jacket is switched from hot to cold and before the adsorber is repressurized for on-stream use. In this manner, the $CO_2$ concentration of the main feed stream gas can be reduced from approximately 145 ppm in line 45′ to less than 1.0 ppm with almost detectable loss of krypton and with only very minor losses of xenon in the $CO_2$ bearing vent gas.

The main gas stream containing krypton is cooled to about −162° C. in heat exchanger 62 by heat exchange with decontaminated overhead gas from column 54 (FIG. 2). The cooled gas is then passed to a xenon adsorber 46 which preferably is comprised of a multiple-bed system of two or more vessels connected in parallel with lines and valves by which each vessel can alternately be placed in service and isolated for regeneration. Also, it is preferred that each vessel be provided with jackets to enable the heating and cooling by flows of relatively hot or cold utility nitrogen thereto. Granular silica gel adsorbent material may be utilized in each bed and thereby reduce the xenon content of the main gas stream from approximately 269 ppm to less than 1 ppm. In operation, at the end of an on-stream (adsorption) period, the main gas stream is diverted from one adsorber to the other with the first adsorber being then depressurized and heated to a temperature of approximately −50° C. During such heating, nitrogen which is adsorbed will be evolved and returned through line 47 with krypton contaminants to line 11 and the inlet of compressor 14. Subsequently, the evolution of gas to line 47 is terminated and further heating is effective to desorb gas from the bed undergoing regeneration which desorbed gas is passed through line 49 to xenon freezeout exchanger 136 illustrated in FIG. 3. Evolution of xenon-rich gas commences at an adsorbent temperature of −52° C. and at the end of such heating, the evolution of xenon is essentially complete. At this point, warm nitrogen eluting gas may be swept through the adsorber undergoing regeneration to remove the last remaining xenon-rich interstitial gas and pass the same to xenon freezeout exchanger 136. With respect to the adsorber receiving the main gas stream, the xenon decontaminated stream is passed through line 48 to the krypton recovery and purification system illustrated in FIG. 2 and which will now be described.

KRYPTON RECOVERY

Referring now to FIG. 2, illustrated therein is an exemplary embodiment of apparatus for recovering a krypton containing feed stream and secondarily purifying the stream to obtain a product containing at least 90% krypton. In accordance with the invention both continuous and batch process techniques are utilized in a new and practical manner to recover krypton from a main feed stream. In addition, recovery and purification of krypton is effected in a manner such that radioactive krypton is not "lost" and is thus safely processed for long term storage. At the same time, the distillation system size and holdup of radioactive krypton are minimized by utilizing techniques which facilitate rapid krypton recovery and purification. The system inventory of krypton is kept low thereby avoiding loss of large quantities of radioactive material upon an unforeseen upset.

Initially, the main gas stream passed from xenon adsorber 46 (FIG. 1) through line 48 and which essentially consists of 99.06 mol percent nitrogen, 29 ppm krypton, 3867 ppm of argon, helium and neon, 0.55% hydrogen and 10 ppb of oxygen is supplied to one pass of heat exchanger 52 wherein the main gas stream is cooled to a temperature of approximately −178° C. by countercurrent heat exchange with the decontaminated overhead gas passed from primary column 54 through line 60 to heat exchanger 52. The so-cooled main gas stream is supplied through line 53 to the lower portion 55 of primary column 54. The decontaminated gas stream exiting heat exchanger 52 is passed through line 61 to heat exchanger 62, previously mentioned in connection with the cooling of the main gas stream supplied thereto through line 45′ prior to passage to xenon adsorber 46 illustrated in FIG. 1.

Distillation column 54 preferably includes a middle section 56 provided with a bed of "Goodloe" packing which provides intimate vapor-liquid contact. This packing is a knitted packing material drawn in wire form and is commercially available from Metex Process Equipment Corporation, Edison, N.J. As the gas stream passes upwardly through packing in section 56, it is contacted with descending reflux nitrogen generated in the upper, condenser section 57 of column 54. This reflux liquid is produced in tubes 79 by heat exchange between liquid nitrogen flowing from supply 74 through line 75, valve 77 and line 78 and the shell side of condenser 57. This liquid nitrogen is vaporized in the shell side of condenser 57 and is passed through line 80 to heat exchanger 67 and then through line 81 either to vent through valve 82 or as recycle gas through line 12 on demand by valve 12*a* for return to the inlet of compressor 14 (FIG. 1). The main gas stream flowing upwardly from the lower portion of column 54 is partially condensed such that all oxygen, a portion of the argon present in the entering gas and all but a minute trace of krypton is liquefied and collected in lower portion 55 of column 54. This bottoms liquid will typically be comprised of about 1–5% krypton although higher concentrations of krypton may be obtained with low levels of the Kr-85 fraction present. As mentioned previously, the non-condensed overhead gas containing a very minute trace of krypton is passed through line 60 to one pass of heat exchanger 52. The product collected in the lower portion 55 of column 54 is continuously supplied through line 84 to to monitor tank 85 which is the interface between the continuous cryogenic system and the krypton batch recovery system.

Typically, a liquid-vapor product is passed to monitor tank 85 as lower portion 55 may not be fully effective to achieve a complete phase separation which is effected in monitor tank 85. Tank 85 is provided with one outlet which communicates with line 86 which in turn enables the passage of liquid through line 88 to the tube side of reboiler 58. Valve 89 is disposed in line 91 and is controlled by the level of liquid in the shell side of reboiler 58 so that as such level increases, the opening of valve 89 is increased and thus, the level of liquid is maintained at a predetermined value in reboiler 58. During purging oxygen contaminated liquid (which may occur after an upset or startup) is passed through valve 87 to line 11 for eventual return to the inlet of compressor 14 (FIG. 1). The liquid in monitor tank 85 will average slightly less than 1.0 mol. percent krypton and is transferred in batches through line 93 and valve 94 to product tank 95. The radioactivity of the liquid phase in the monitor tank 85 will be approximately 89,500 Ci. A liquid level indicator 90 is effective to control the opening of valve 77 and thus corrects the rate of flow of utility nitrogen from supply 74 through line 78 to condenser 57 of primary distillation column 54. Thus, should the level of liquid in monitor tank 85 rise above a predetermined value, e.g. 80% level, such change is detected and the flow of liquid nitrogen and hence the production of reflux in column 54 is accordingly reduced thereby reducing the rate of forming liquid product in the lower portion 55 of column 54. A line 92 is also provided so as to enable communication between the head space of monitor tank 85 and the lower portion 55 of column 54. In essence, monitor tank 85 operates to separate liquid and vapor phases therein with the vapor phase being returned through line 92 to column 54 as mentioned hereinabove. The portion of line 86 extending beyond valve 87 normally contains no flow but may be utilized for the purpose of purging any oxygen from monitor tank 85 and in such event, a small amount of liquid in line 86 is vaporized and then returned through valve 87 to line 11 and the inlet of compressor 14 illustrated in FIG. 1.

In order to efficiently recover a krypton-rich product in the lower portion 55 of column 54, reflux liquid (nitrogen) is produced in the following manner such that relatively high liquid-vapor ratios, e.g. approximately 0.4–0.5, may be obtained. As mentioned previously, the overhead gas in line 60 is passed through heat exchanger 52, line 61, heat exchangers 62 and 62' and then through line 63' to compressor 64. The pressure of this gas stream is increased to approximately 10.3 kg/cm$^2$ after which this gas is passed through line 65 to aftercooler 69 wherein the temperature is reduced to approximately 47° C. This gas stream continues through line 65 to one pass of heat exchanger 67 wherein the gas is cooled to a temperature of approximately −169° C. against nitrogen vapor in line 80 before passage through line 71 through line 68 to the shell side of reboiler 58. A small trim stream may be intermittently taken off line 71 and returned through valve 70 to line 60 in the event it is necessary to adjust the amount of gas flowing therein through heat exchangers 52, 62 and 62' and, in this manner, the temperature to which the main gas stream is cooled before entering $CO_2$ adsorber 45 and adsorber 46 may be controlled. A portion of the recycle stream passing through heat exchanger 67, e.g. about 13% will be in a liquefied state; the remainder of this stream will be almost completely condensed in reboiler 58 against a flow of liquid from monitor tank 85 through lines 86 and 88. This liquid is reboiled in the tube side of reboiler 58 prior to passage through line 91 to the bottom portion 55 of column 54. A liquid/vapor ratio of about 6 is established in line 91. The liquefied recycle stream exits reboiler 58 through valve 89 and in turn is merged with the utility nitrogen supplied from vessel 74 which, as mentioned heretofore, is effective to condense vapor in condenser 57 and thereby provide reflux liquid for operation of column 54. Thus, by recycling overhead gas from column 54, as described above, and utilizing such recycled stream to continuously form reflux liquid, a liquid to vapor ratio approaching 0.5 is achieved in column 54 without direct use of a quantity of utility liquid nitrogen equal to the entire required reflux flow, but only a quantity necessary to neutralize heat of radioactive decay, "heat leak", and heat exchanger warm end losses.

The nitrogen liquid which is evaporated in condenser 57 emerges through line 80 and is passed through heat exchanger 67 wherein the recycled stream is cooled as mentioned above. Line 81 is provided to enable a return of this decontaminated nitrogen gas stream from heat exchanger 67 either to vent through valve 82 or for return to the inlet of compressor 14 (FIG. 1) via line 12. Finally, a minor portion of the recycle stream flowing through line 71 which is not condensed in reboiler 58, namely hydrogen and some nitrogen, are returned through line 72 and valve 73 to line 28 for merging with the hydrogen stream supplied through line 21 (FIG. 1) to deoxidizing reactor 24. A very minor portion of the gas stream in line 72 may be vented to atmosphere through valve 73' to reduce the level of noncondensibles such as helium and neon. Since this stream has already been decontaminated by passage through column 54, its krypton content will be of the same approximate concentration as the main vent gas stream passing through valve 82.

In accordance with the invention, the relatively dilute krypton liquid recovered in monitor tank 85 is subsequently concentrated to a greater purity (of preferably 90 mol. percent or greater) in a batch wise fashion with concentrated krypton liquid being vaporized, heated and supplied to storage cylinders for retention in an isolated, safe condition for a period of time long enough for complete extinction of the krypton 85 isotope, e.g. about 100 years. In addition, the accretion of potentially hazardous constituents such as oxygen and ozone, which are capable of forming potentially explosive conditions, is avoided. In broad terms, the krypton batch purification according to the invention includes the steps of filling tank 95 with batches of krypton-containing liquid derived from monitor tank 85, partially evaporating liquid in tank 95 to a predetermined volume, transferring this remaining liquid to reboiler 105 of krypton distillation column 103, performing batch distillation, transferring the batch column product to a product transfer tank 117 and finally, removing a product comprised of 90 mol. percent krypton and balance argon from tank 117 for vaporization and storage in cylinder 122. In this manner, efficient use is made of secondary distillation column 103 and thus the size of this column for a given volume of krypton to be concentrated is minimized without impairing the safety of handling highly radioactive materials such as Kr85.

In order to purify and concentrate the relatively dilute liquid in monitor tank 85, valve 94 is periodically opened to intermittently pass such liquid through line 93 to column feed tank 95. Typically, about one third of the liquid contained in tank 85 is transferred as a batch to column feed tank 95. Upon so transferring this liquid, which is comprised essentially of approximately 0.94 mol. percent krypton, balance nitrogen and argon, and small variable amounts of $O_2$ and $O_3$, the vapor space of column feed tank 95 is connected by line 102 with reboiler portion 105 of secondary distillation column 103. This is accomplished by opening valve 101 while valves 97 and 99 remain closed. Flow of the vapor fraction from column feed tank 95 to reboiler 105 and the subsequent passage of this vapor upwardly through column 103 will result in a cooling of this column which is necessary due to the intermittent operation thereof. Vapor exiting column 103 is recycled to column 54 through lines 110 and 112 and valve 111. This vapor flow which results from evaporation of liquid in product feed tank 95 due to heat leak and the heat of radioactive decay, and also by means of heater 96 if necessary, continues until approximately 10% of the original liquid charge in feed tank 95 remains therein. At this point, valve 101 is closed and valve 97 is open so that a pressurized transfer of this liquid (which contains at least 5% krypton) from tank 95 to reboiler 105 occurs through line 98.

Secondary distillation column 103 includes, in addition to reboiler 105, a packed section 106 which is preferably comprised of a twisted wire type packing and which operates at a liquid to vapor ratio above 0.8. The upper portion of column 103 is comprised of condenser section 107 having a coil or tubes 108 therein and which is effective upon the flow of liquid nitrogen from supply 74, line 76 and valve 104 to establish reflux in column 103. In operation, once the remainder of the batch liquid is transferred from feed tank 95 to reboiler 105, heat leak and radioactive decay together with heat supplied by an internal heating coil 114 are effective to generate vapor which passes upwardly through packed section 106 and contact with reflux liquid results in the progressive concentration of krypton in reboiler section 105. This batch distillation is controlled by regulating the flow of liquid nitrogen through line 76 and valve 104 to condenser 107 by control apparatus well known to those skilled in the art. A relatively small stream of overhead gas of approximately 40% nitrogen and 60% argon is discharged from condenser portion 107 through line 110, valve 111 and line 112 through line 100 and line 92 to the lower portion 55 of primary distillation column 54. Batch distillation is complete in secondary column 103 when the krypton content of the liquid phase in reboiler 105 reaches 90 percent and this concentration may be detected by a known device 123. The final temperature of reboiler liquid will be approximately −132° C. and this liquid will be under a pressure of about 7.8 kg/cm$^2$ absolute. The composition of the overhead gas removed through line 110 is approximately 0.1 mol. percent krypton, balance nitrogen and argon, and by recycle to column 54, this residual krypton is not "lost" from the system.

Transfer of the krypton-rich liquid in reboiler 105 is preferably effected in accordance with the invention by means of a pressurized transfer to tank 117 through a dip tube 115. Initially, valve 116 is closed while a flow of liquid nitrogen from tank 124, which receives liquid nitrogen from supply 74, is effective upon passage through coil 126 interiorly of tank 117 to cool and reduce the pressure therein to a level approximately 1.0 kg/cm$^2$ below the pressure in reboiler 105. The nitrogen passing from coil 126 to line 127 is returned to tank 124 wherein a liquid-vapor separation occurs and excess nitrogenn vapor may be vented through line 128. By opening valve 116 in line 115, the pressurized transfer of the liquid content of reboiler 105 will occur. The internal dip tube 115 insures that the liquid phase is transferred first and thus prevents any unintentional ozone buildup in reboiler 105. This is important as oxygen will concentrate in monitor tank 85, product tank 95 and reboiler 105 to the same degree krypton is concentrated. The concentration of oxygen (and ozone) is limited to avoid potential safety hazards as mentioned above. Upon transfer of the entire liquid contents of reboiler 105, column 103 and feed tank 95 are pressure equalized with primary column 54 by opening valve 111 in the overhead line above column 103 which prevents gas surges from occurring when the feed tank 95 is next filled with a batch of krypton containing liquid from monitor tank 85.

The foregoing steps required to fill product tank 117 may be repeated several times at which point upon closure of valve 116, liquid is removed from tank 117 upwardly through the lower end of dip tube 115, through line 118 to heater 119. The krypton-rich liquid in line 118 is thus vaporized and warmed and may be passed through valve 120 and check valve 121 to a suitable storage cylinder 122. It will, of course, be understood that a suitable manifold device may be provided to enable the filling of a plurality of cylinders corresponding to cylinder 122. The gas passed to cylinder 122 will be essentially comprised of 90 mol. percent krypton and the balance argon. Accordingly, a highly enriched krypton containing gas, preferably comprised of at least 90% krypton, may be stored in suitable cylinders and thus, relatively little storage space is required to enable adequate storage of krypton recovered from a nuclear process off-gas stream.

XENON PURIFICATION

Figure 3:
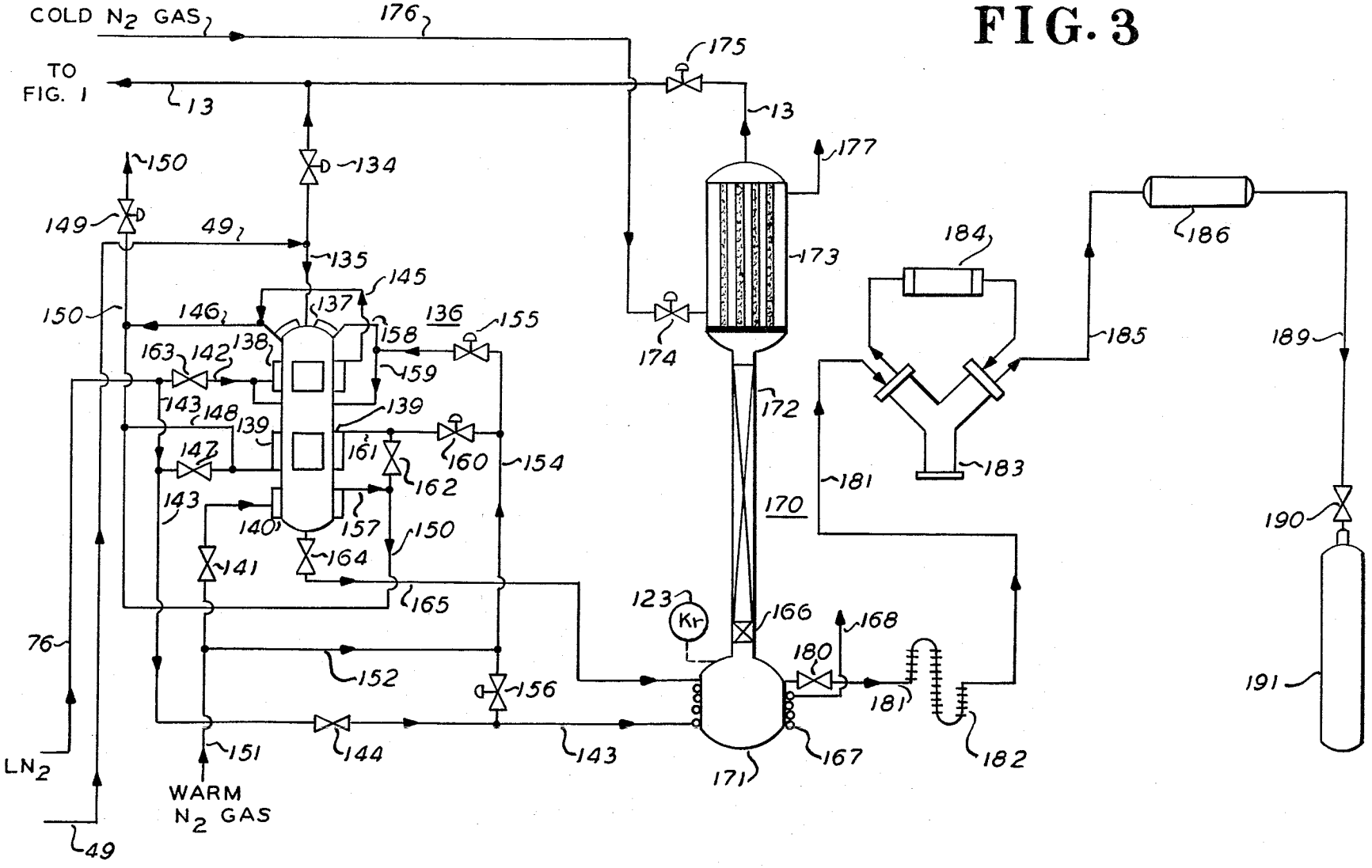
FIG. 3 is a partial schematic view of apparatus for purifying xenon by the process according to the invention.

As mentioned previously, xenon is adsorbed from the main gas stream by means of adsorber 46 and is passed in a batch basis over line 49 (FIG. 1) to the xenon purification system illustrated in FIG. 3. This latter system is essentially comprised of a xenon freezeout vessel 136 wherein the xenon concentration of the gas supplied to line 49 is substantially increased prior to distillation of xenon in column 170. In broad terms, the xenon purification system operates in the following manner; the xenon freezeout vessel 136 is precooled before being charged with the adsorbate from adsorber 46, all contents charged into the freezeout vessel are liquefied or solidifed, nitrogen is then evaporated from such charge, solid xenon is then melted prior to transfer of a "crude" xenon batch to distillation column 170 wherein the xenon fraction is increased to 95 mol. percent with less than 100 ppm krypton, the latter being solidifed and/or liquefied in freezeout vessel 136.

Before discussing the operation of the xenon purification system, illustrated in FIG. 3, the freezeout vessel 136 and related piping and valve arrangements will be described. Freezeout vessel 136 is provided with a plurality of heat exchange panels 137–140 with the external portions of such panels being comprised of semi-circular piping with the relatively planar portion thereof being welded to the exterior surface of vessel 136. Panels 138 and 139 are also preferably in communication with internal heat exchange means and are typically of a "squirrel cage" arrangement of tubes to effect heat exchange both internally and externally with upper and middle portions of vessel 136. Top panel 137 and bottom panel 140 are preferably only provided exteriorly of vessel 136. Incoming adsorbate gas from xenon adsorber 46 (FIG. 1) is passed through line 49 and line 135 into the upper portion of vessel 136. The contents of this vessel may be removed from the bottom thereof through valve 164 and line 165 and passed to reboiler 171 of column 170. In addition, overhead gas from vessel 136 may be removed therefrom upon opening of valve 134 and passed through line 13 for return to the inlet of compressor 14 (FIG. 1) thereby assuring that any krypton contained in such overhead gas is returned to the purification process.

Upper panel 137 of vessel 136 is provided for the purpose of preventing plugging or clogging of the top opening of vessel 136 due to freezing of xenon. Warm nitrogen gas may be supplied to this panel selectively through lines 151, 152 and 154, valve 155, line 158 and such gas may be removed from panel 137 through line 146 to line 150 for venting through valve 149. In addition, warm nitrogen gas may be similarly supplied to upper panel 138 through the aforementioned piping and valving except such gas is supplied through line 159 to line 142 and then into upper panel 138. Nitrogen gas may be removed from panel 138 through line 145 which joins line 146 for venting through line 150. Warm nitrogen gas may also be supplied to middle panel 139 through line 154, valve 160 and then vented through lines 148 and 150. Finally, warm nitrogen gas may be selectively supplied to bottom panel 140 through valve 141 and passed to vent through line 157 and line 150.

Freezeout vessel 136 is refrigerated preferably by liquid nitrogen supplied over line 76 to either panel 138 or panel 139. In addition, liquid nitrogen may be supplied through lines 76 and 143 through valve 144 to coils 167 appropriately disposed about reboiler 171 of distillation column 170. Line 76 may be selectively placed in communication with panel 138 by means of valve 163 which is coupled to line 142 and then to panel 138. Evaporated nitrogen may be removed from panel 138 through line 145 which joins line 146 for passage of nitrogen gas to vent through line 150. In addition, liquid nitrogen may be supplied to panel 139 through lines 76 and 143, through valve 147 with evaporated nitrogen (gas) being withdrawn from panel 139 through line 161, valve 162 for passage to line 150 and then to vent.

The xenon adsorber 46 effluent gases are typically comprised of 90.4% nitrogen, 9.6% xenon and 0.03% krypton and batches of this gas are passed through line 49 and line 135 into freezeout vessel 136 wherein a crude xenon product is recovered.

In operation, middle panel 139 of vessel 136 is cooled to an operating temperature of −190° C. by means of a flow of liquid nitrogen through lines 76 and 143 through line 147 to panel 139. Upon reaching this temperature, the aforementioned effluent gas of adsorber 46 is charged into vessel 136 while panel 139 is maintained at the aforementioned temperature. During such charging, top panel 137 is kept warm by tthe circulation of warm nitrogen gas through lines 151, 152 and 154, valve 155 and line 158 to panel 137. The contents of freezeout vessel 136 are completely condensed at a temperature of −190° C. on the internal surfaces of panels 139 while, as mentioned above, panel 137 is kept warm to prevent plugging of the inlet area during charging with solid xenon. At the end of the charge cycle, nitrogen and krypton will be in the liquid phase in vessel 136 and the major portion of xenon will be in the solid phase, a small fraction of xenon being dissolved in nitrogen liquid and some krypton may be dissolved in solidified xenon.

The solidified xenon will be distributed on the internal exchanger surfaces (internal panels of panel sections 138 and 139) and will collect in the pool of liquid condensate at the bottom of vessel 136. Upon conclusion of the charge cycle, freezeout vessel 136 is isolated from the adsorber system by closure of the appropriate valves (not shown) in line 49 and upper panel 138 and middle panel 139 are refrigerated by evaporation of liquid nitrogen at a pressure of approximately 2.15 $kg/cm^2$ absolute. Liquid nitrogen is supplied through line 76, valve 163 and line 142 to panel 138 and as mentioned previously, through lines 76 and 143 through valve 147 to panel 139. The evaporation pressure is regulated by means of valve 149 in vent line 150. When the upper zone of vessel 136 has been cooled at panel 138 to a temperature of −180° C. or so, valve 134 is placed on automatic control and opened to permit boil-off gas to be recycled through line 13 to the inlet of compressor 14 (FIG. 1). At this time, warm nitrogen gas is passed through line 151 and valve 141 to the bottom panel 140 thereby commencing evaporation of the liquid phase of nitrogen. Because of the low solubility of xenon in nitrogen, evaporation proceeds isothermally without significant liquid phase concentration change. The refrigeration of portions of vessel 136 corresponding to panels 138 and 139 with liquid nitrogen at slightly elevated pressure serves to repress evaporation of any adherent xenon from stray heat flow without cooling the evaporated process nitrogen below its saturation temperature. When the last nitrogen liquid phase has boiled or evaporated, continued heating by the flow of warm nitrogen gas to panel 140 produces a temperature at this location in vessel 136 of −112° C. and concludes the evaporation step. Valve 134 is then closed as is valve 141 to discontinue heating of bottom panel 140. The flow of liquid nitrogen to panels 138 and 139 is then terminated by closing valves 163 and 147, respectively.

The melting of solid xenon is effected by heating the top middle and bottom portions of vessel 46 corresponding respectively to panels 138, 139 and 140 in succession from the top down. Warm nitrogen gas is first passed through panel 138 by means of lines 153, 154, etc. until a temperature in vessel 136 at a location corresponding to panel 138 of −112° C. is reached. At this time, valve 155 is closed to discontinue heating of panel 138 while valve 160 is opened to commence heating of panel 139 again by passage of warm nitrogen gas therethrough. This heating is preferably continued until the temperature in vessel 136 at a location corresponding to panel 139 reaches −112° C. At this point, valve 160 is closed and valve 141 is opened to effect a heating of vessel 136 at locations corresponding to bottom panels 140 and such heating is continued until a temperature at these locations of −105° C. is reached. Valve 141 is then closed and vessel 136 is permitted to stand until a liquid level is detected by suitable devices in the lower portion of vessel 136. At this point, a relatively rich xenon crude product is collected in the bottom of freezeout vessel 136 in liquid phase. This liquid product will be approximately 99.7% xenon and 0.3% krypton and is suitable for transfer to distillation column 170 for further removal of krypton from this crude xenon product. It will be appreciated that by transferring such a xenon-rich product to distillation column 170 virtually free of nitrogen, it will be unnecessary to reflux in column 170 a mixture having a substantial nitrogen content. The importance of this is that by so avoiding nitrogen in the mixture passed to column 170, the very low temperatures (−190° C. or so) which would occur of necessity upon condensation of nitrogen portions of a reflux, conditions are avoided in column 170 which would cause the freezing of xenon and hence the clogging or plugging of such a column. Thus, in accordance with the present invention, column freezeup is avoided without impairing the ability of such column to thoroughly distill a crude xenon stream such that a xenon product having 100 ppm krypton or less may be recovered.

Liquid crude xenon is transferred from freezeout vessel 136 to the reboiler section of column 170 in the following manner. Initially, valve 144 is opened to permit a flow of liquid nitrogen through line 143 to coils 167 of reboiler 171 thereby cooling the reboiler and causing a slight pressure drop therein. Upon the pressure in reboiler 171 being reduced below the pressure in vessel 136, valve 164 is opened to permit the crude xenon liquid to flow to reboiler 171. The flow of liquid nitrogen is temporarily interrupted by closure of valve 144 and it is then resumed to effect a gradual transfer of xenon to the reboiler 171. The freezeout vessel 136 is then disconnected from reboiler 171 by closing valve 164 and liquid nitrogen is then supplied to panel 139 of vessel 136 through line 143 and valve 147 to fix any residual xenon vapor in place and depressurize vessel 136 until the next batch of adsorber effluent is supplied thereto through line 49.

At this point, the crude xenon product in reboiler 171 of column 170 is in readiness for distillation. The pressure in reboiler 171 is brought to the same pressure of the packed section 172 of column 170 by controlling the flow of liquid nitrogen to coils 167 of reboiler 171. Upon equalization of these pressures, column valve 166 is opened and flow of liquid nitrogen to coil 167 is terminated by closure of valve 144. It should be noted that evaporated liquid nitrogen from coil 167 may simply be vented to atmosphere through line 168. In order to generate reflux liquid, cold nitrogen gas is supplied through line 176 and valve 174 to condenser 173 of column 170. This nitrogen gas may be simply vented to atmosphere through line 177 as illustrated in FIG. 3. The reflux liquid generated in condenser 173 will be essentially comprised of xenon and krypton and hence, by avoiding reflux containing nitrogen fractions, the low temperatures necessary to achieve reflux are avoided as are problems of xenon freezing in column 170. Column 170 operates at a liquid to vapor ratio of at least 0.8 and preferably approximately 0.975. Valve 175 is slightly opened to release any nitrogen gas which may exist in column 170 as a result of being dissolved in the crude xenon product passed to reboiler 171. However, this nitrogen content is minimal and does not affect the ability of condenser 173 to produce necessary reflux liquid. As distillation proceeds in column 170, a small overhead stream comprised approximately of 90% xenon and 10% krypton gas is passed through line 13 and valve 175 for return to the inlet of feed compressor 14 (FIG. 1), thus preventing the loss of any radioactive krypton from the overall system. Distillation is complete when the xenon column bottoms liquid composition contains less than 100 ppm krypton as indicated by krypton sensing device 123. At this point, valve 166 is closed to terminate distillation.

In order to remove the purified liquid xenon batch in reboiler 171, valve 156 is opened thereby passing warm nitrogen gas to coils 167 and vaporizing the liquid xenon product. The resulting xenon gas containing less than 100 ppm of krypton is passed through valve 180 and line 181 through heater 182 to xenon compressor 183. This compressor is provided with an intercooler 184 and the outlet line thereof 185 is coupled through an aftercooler 186 so that cooled, compressed xenon gas at a pressure of approximately 92 kg/cm$^2$ absolute may be passed through line 189 and valve 190 into storage cylinder 191. It will be understood that a suitable manifold system may be utilized with appropriate valving to fill a plurality of cylinders similar to storage cylinder 191. In this manner, xenon gas contaminated by minor quantities of krypton may be retained for a sufficiently long time period for the Kr-85 isotope to decay to safe levels, or, alternatively, in the event that the krypton concentration of such xenon is substantially less than 100 ppm, the xenon product may be used for other purposes than merely storage to effect decay of radioactive krypton isotopes. Krypton concentration below 100 ppm may be obtained by maintaining valve 175 closed for longer periods of time and continuing reflux in column 170 for such longer periods. Krypton concentration in reboiler 171 may be detected by a known krypton detecting device 123.

In addition, it will be appreciated that as freezeout heat exchanger 136 is effective to produce a gas comprised of 99% or greater xenon, it may not be necessary in the treatment of all nuclear process off-gases to reduce the krypton impurity concentration of such xenon to less than 100 ppm. In this latter event, distillation column 170 will not be necessary.

The foregoing and other various changes in form and details may be made without departing from the spirit and scope of the present invention. Consequently, it is intended that the appended claims be interpreted as including all such changes and modifications.

What is claimed is:

1. A process for recovering krypton from a feed gas stream comprised of krypton, hydrogen, nitrogen, less than 0.1 ppm oxygen and one or more inert gases from the group consisting of argon, helium and neon comprising the steps of:

(a) continuously contacting said feed gas stream in a primary distillation column with a reflux liquid to produce a bottoms liquid-vapor containing up to about 5% krypton;

(b) continuously passing said primary column bottoms liquid and vapor to a storage vessel wherein said liquid and vapor phase are separated;

(c) intermittently withdrawing a portion of said liquid from said storage vessel and passing said withdrawn liquid as a batch to an evaporator;

(d) partially evaporating said liquid batch in said evaporator to increase the krypton fraction; and (e) passing said remaining partially evaporated liquid to a second distillation column to produce a bottoms liquid comprised of at least 90% krypton.

2. The process defined in claim 1 additionally comprising the steps of: passing liquid nitrogen to said primary column to generate column reflux; sensing the level of liquid in said storage vessel; and controlling the flow rate of said liquid nitrogen to said primary column in response to said sensed liquid level to thereby control the rate at which said column bottoms liquid is formed and to maintain a predetermined liquid level in said storage vessel.

3. The process defined in claim 1 wherein the step of continuously distilling said feed gas stream comprises producing a bottoms liquid of about 1.0% krypton.

4. The process defined in claim 1 additionally comprising the step of returning the vapor phase separated in said storage vessel to the primary column.

5. The process defined in claim 4 additionally comprising the steps of continuously passing liquid from said storage vessel to a reboiler vessel to reboil said liquid; and returning said vaporized liquid to said primary column.

6. The process as defined in claim 5 additionally comprising the steps of supplying liquid nitrogen to said column to generate reflux therein; withdrawing overhead gas from said primary column, warming, compressing and cooling withdrawn overhead gas; recycling said withdrawn overhead gas to said reboiler vessel to condense said recycled gas and merging said condensed recycled gas with said liquid nitrogen supplied to said primary column to thereby reduce the amount of liquid nitrogen necessary to generate reflux in said column.

7. The process as defined in claim 1 additionally comprising the step of passing vapor produced upon evaporation of liquid in said evaporator to said second column to cool said column prior to passage of liquid from said evaporator to said second column.

8. The process as defined in claim 1 additionally comprising the steps of passing the batch bottoms liquid in said second column through a dip tube extending into a product storage vessel upon completion of batch distillation in said second column and isolating said product storage vessel from said second column upon completion of transfer of said batch.

9. The process as defined in claim 8 additionally comprising the step of cooling said product storage vessel prior to the transfer thereto of said second column bottoms liquid to thereby reduce the pressure in said product storage vessel below the pressure in said second column and to enable a pressure transfer of said second column bottoms liquid through said dip tube.

10. The process as defined in claim 9 additionally comprising the steps of passing liquid in said product storage vessel to means for vaporizing said liquid and passing said vaporized liquid to gas storage means.

11. The process as defined in claim 10 wherein said liquid includes radioactive krypton and the step of passing liquid comprises terminating cooling of liquid in said product storage vessel thereby permitting heat of radioactive decay to pressurize said liquid and pass said liquid through said dip tube to said vaporizing means and said gas storage means.

* * * * *